United States Patent [19]

Smith

[11] 4,228,718

[45] Oct. 21, 1980

[54] MAGIC CHORDER

[76] Inventor: Robert L. Smith, 1037 E. Beddell St., Fort Worth, Tex. 76115

[21] Appl. No.: 943,197

[22] Filed: Aug. 28, 1978

Related U.S. Application Data

[63] Continuation-in-part of Ser. No. 828,415, Aug. 29, 1977, abandoned.

[51] Int. Cl.[3] ..... G10D 3/00

[52] U.S. Cl. ..... 84/317; 84/444

[58] Field of Search ..... 84/315–319, 84/444

[56] References Cited

U.S. PATENT DOCUMENTS

| | | | |
|---|---|---|---|
| 370,582 | 9/1887 | Wigand | 84/315 |
| 804,553 | 11/1905 | Sauer | 84/317 |
| 3,546,995 | 12/1970 | Semprevivo | 84/444 |
| 3,682,036 | 8/1972 | Null et al. | 84/317 |

FOREIGN PATENT DOCUMENTS

| | | | |
|---|---|---|---|
| 1076475 | 2/1960 | Fed. Rep. of Germany | 84/317 |

*Primary Examiner*—Lawrence R. Franklin

[57] ABSTRACT

Both finger and foot operated, electrical keyboards supply current through connectors to fret selecting devices which are mounted on fretted, stringed, musical instruments, said devices being guided in an array of note and chord formations so that notes and chords are formed when the devices are activated.

6 Claims, 8 Drawing Figures

MAGIC CHORDER

This application is a continuation-in-part of Ser. No. 828,415, filed Aug. 29, 1977, now abandoned.

This invention relates specifically to the guitar, a single member of the family of fretted, stringed, musical instruments, and more particularly to the improvement of the electromagnetical playing techniques of said guitar by adding a completely new foot controlled electromagnetic circuit matrix to the former finger controlled electromagnetic circuit matrix.

In the prior art Karl-Heinz Johannsmeier, German Pat. No. 1,076,475, granted Feb. 25, 1960, and Cecil A. Null and Robert H. Klinger, U.S. Pat. No. 3,682,036, granted Aug. 8, 1972, both have inventions that relate to stringed, musical instruments as a general class. Nathaniel Banks Gregier, U.S. Pat. No. 1,570,947, granted on Jan. 26, 1926, has an invention that relates to stringed, musical instruments of the viol class. All of the above mentioned inventors refer only to finger operated means.

A main object of this invention is to develop a dual system of foot and finger operated means thereby extending the creative, musical, sound combinations possible at any instant in time.

A further object of this invention is to develop a new dual foot and finger system of fretted, electromagnetic instrumentation which will be easy to operate thereby extending the practical application of the skills, aptitudes, and abilities of the average musician.

A further object of this invention is to develop a new dual foot and finger switch system for operating a guitar electromagnetically whereby the electromagnetic assemblies are activated by said foot and finger switches that release electric current into said electromagnetical assemblies.

These developments are further exemplified in the following description and claims, and from the accompanying drawings wherein:

Figure 1:
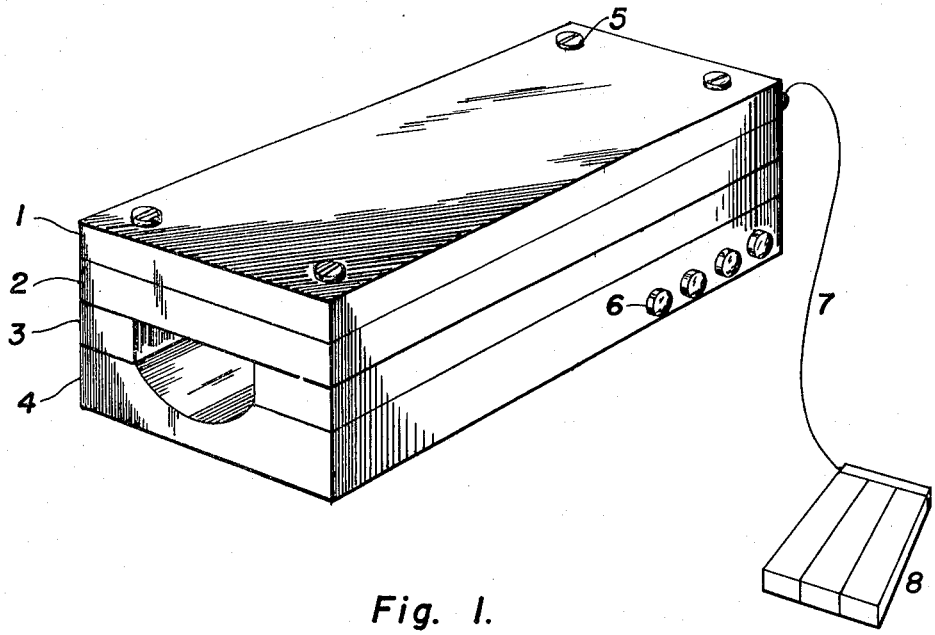
FIG. 1 is an external perspective view of the Magic Chorder.

Referring to the drawings FIG. 1 illustrates the finger and foot switches (6,8) means for controlling the electromagnetic assemblies (FIGS. 4, 5) the bolting mechanism (5) for securing said Magic Chorder to the guitar, the sectional body panels (FIG. 1; 1,2,3,4) for suspension of said electromagnetic assemblies over the strings and frets of the guitar and for stabilizing said finger switches, and the electrical wire extension (7) extending from said foot controlled switches to the terminals of the said electromagnetic assemblies to the terminals of the current source.

Figure 2:
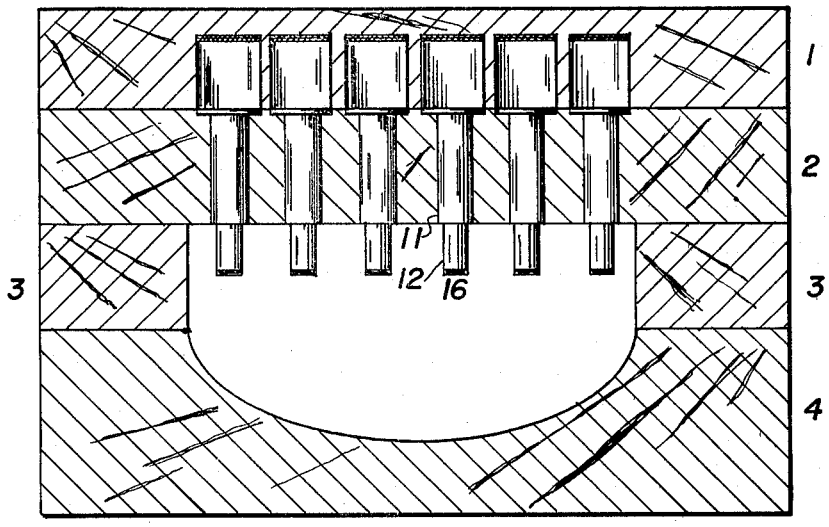
FIG. 2 is a transverse vertical cross-sectional view of the Magic Chorder.

FIG. 2 illustrates the electromagnetic assemblies (FIGS. 4, 5) suspended over the imaginary strings and frets, the rods (12) in an inactive position above the said imaginary strings and frets, and the sectional body panels (1,2,3,4) for the mounting of said electromagnetic assemblies over the said strings and frets of the guitar.

Figure 3:
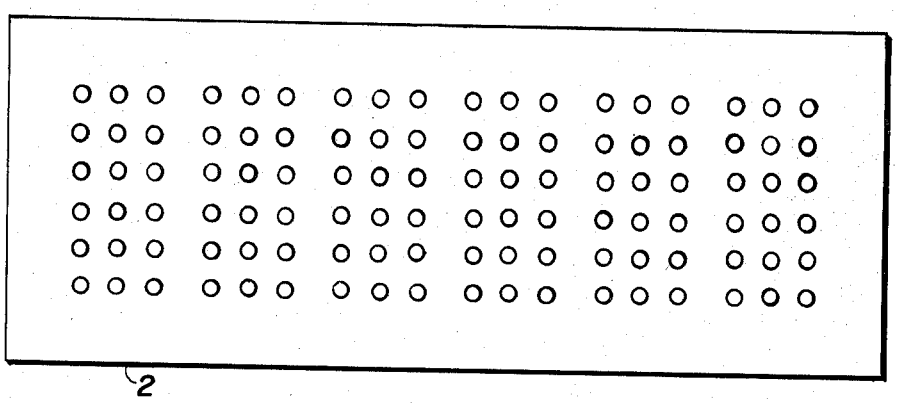
FIG. 3 is a perspective view of the panel bar which mounts the electromagnetic assemblies.

FIG. 3 illustrates the panel bar for the mounting of the electromagnetic assemblies (FIGS. 4, 5) with emphasis upon the various placements which are possible with respect to the chording arrangements.

Figure 4:
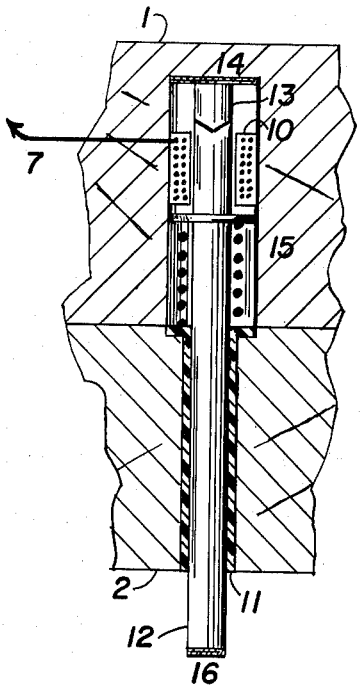
FIG. 4 is a vertical cross-sectional view of the foot operated electromagnetic assemblies.

FIG. 4 illustrates the coil (10) of a solenoid for generating magnetic flux being located in a recess in housing panel (1), the metal portion of the rod (13) for receiving magnetization from the coil (10), the shock absorbing material (14) for reducing noise, the spring (15) for returning the rod (12) to the inactive position over the frets, the plastic tube (11) for the mounting of the coil (10) and for enclosing the rod (12), the wood portion of the rod (12) for extending the magnetic pressure of said coil to the said frets, the shock absorbing material (16) for reducing noise, and the electric extension (7) for carrying current to the coil (10) of the electromagnetic assemblies (FIG. 4).

Figure 5:
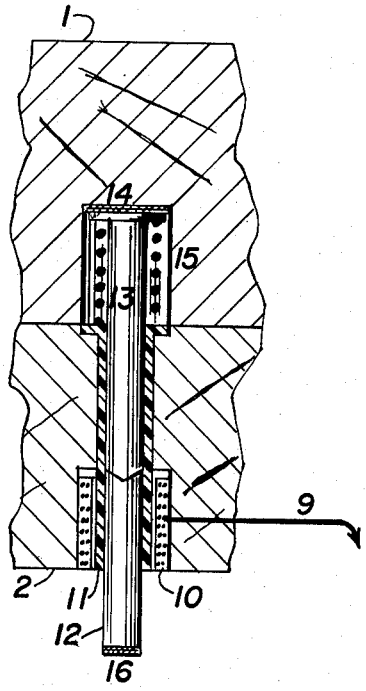
FIG. 5 is a vertical cross-sectional view of the finger operated electromagnetic assemblies.

FIG. 5 illustrates the coil (10) for generating magnetic flux being located in a recess in guide panel (2), the shock absorbing material (14) for reducing noise, the spring (15) for returning the rod (12) to the inactive position over the frets, the metal portion of the rod (13) for receiving magnetization from the coil (10), the plastic tube (11) for mounting the coil (10) and for enclosing the rod (12), the rod (12) for extending the magnetic pressure from the said coil to the frets, the shock absorbing material (16) for reducing noise, and the electric extension (9) for carrying current to the said coils of the electromagnetic assemblies (FIG. 5).

Figure 6:
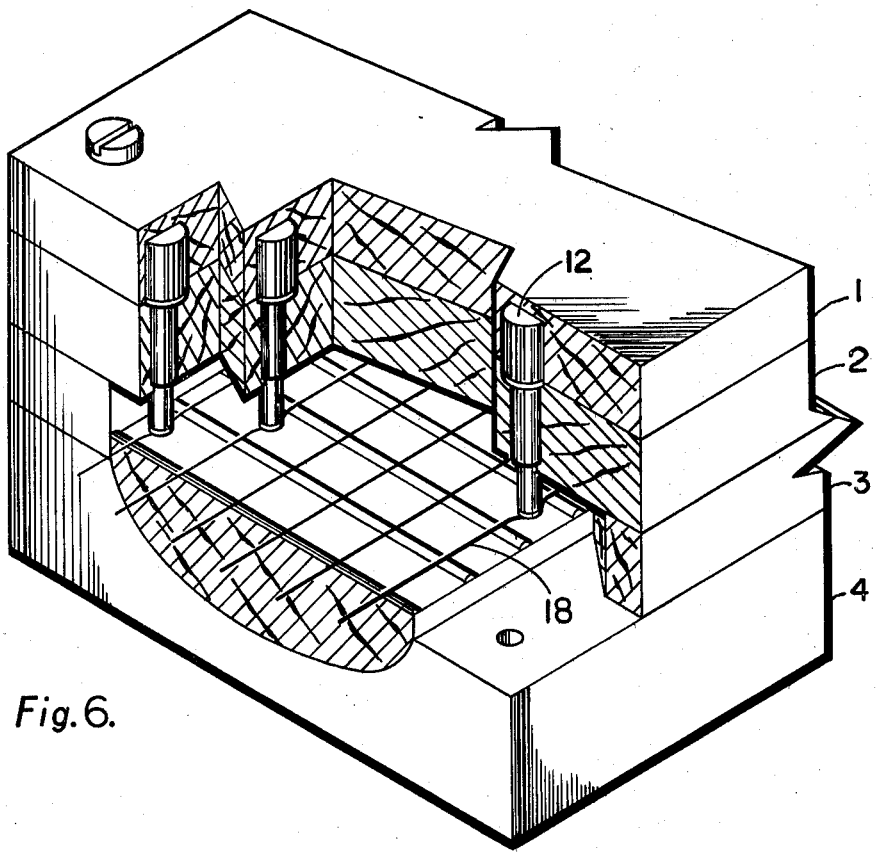
FIG. 6 is a fragmentary perspective cutaway view of the cord G7.

FIG. 6 illustrates the rods (12) of the electromagnetic assemblies electromagnetically forming a typical chord, G7, on the strings (18) and frets of a guitar.

Figure 7:
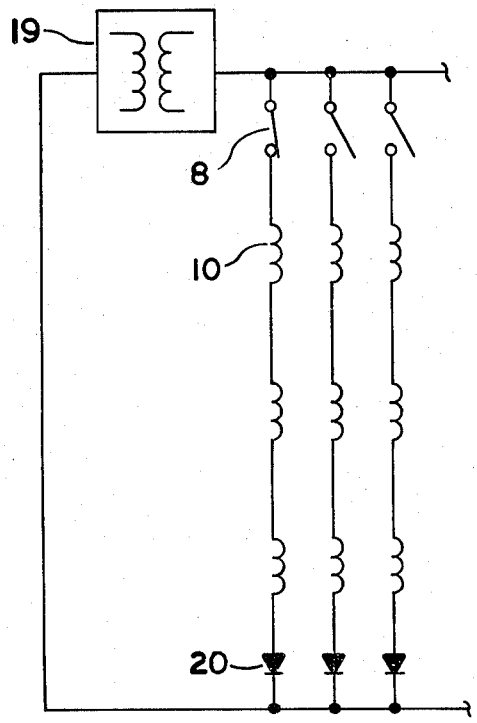
FIG. 7 is a partial electrical schematic diagram of chord G7.

FIG. 7 schematically illustrates the parallel leads connected to the terminals of the current source for the transference of current to the coils (10) of the electromagnetic assemblies (FIGS. 4, 5) in the fret selecting means, the foot switch (8) having been closed for the electromagnetic formation of chord G7.

Figure 8:
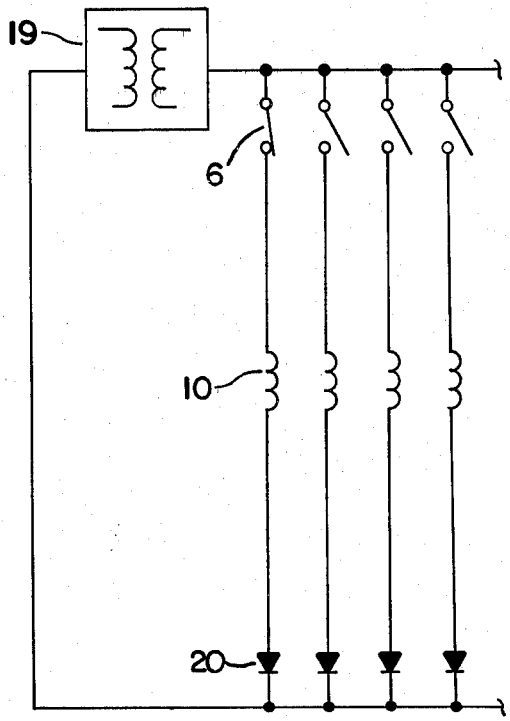
FIG. 8 is a partial electrical schematic diagram of an orchestrial sound.

FIG. 8 schematically illustrates the parallel leads connected to the terminals of the current source for the transference of current to the coils (10) of the electromagnetic assemblies (FIGS. 4, 5) in the fret selecting means, the finger switch (6) having been closed for the electromagnetic formation of an orchestrial sound.

Referring to the drawings for mode of operation, the finger and foot switches (FIG. 1; 6,8) respond to the touch of the musician, thus making extremely fast electrical contact to the current source (19), the foot switches (FIG. 1; 8) having been programmed to electromagnetically fret the strings of the guitar for the fundamental chords and the finger switches (FIG. 1; 6) having been programmed to electromagnetically fret the strings of the guitar for additional, orchestrial sounds.

As the current proceeds along the electrical leads in the guitar with fret-selecting means, it approaches the fret-selecting electromagnetic assemblies (FIGS. 4, 5) and produces an electromagnetic flux in the coils (10) of the said electromagnetic assemblies which produces magnetic pull on the metal portion of the plunger (13) which overpowers the resistance of the spring (15) and exerts pressure via the wood or plastic portion of the plunger (12) upon the strings of the said guitar slightly behind the proper frets to form various chords and orchestrial sounds needed to complete a successful performance of the Magic Chorder when the strings (FIG. 6; 18) of the said guitar are vibrated in conjunction with the operation of the foot and finger switches (FIG. 1; 8,6).

The drawings in FIG. 4 and FIG. 5 reveal the tubes with flanges (11) which guide the plungers (12) with noise reducing materials (16) to the appropriate strings and frets of the guitar.

The drawings in FIGS. 1 and 2 show the spacing bars (3) which accurately mounts the electromagnetic assemblies (FIGS. 4, 5) of the fret-selecting means over the strings and frets of the guitar, and the base (4) which mounts the Magic Chorder to the said guitar.

As drawn in FIG. 6 the plungers (12) are arrayed behind frets one, two, and three on strings one, five, and six (18) forming chord G7.

As drawn in FIG. 7 the partial, electrical, schematic diagram illustrates the current flowing from the source (19) into the parallel leads through the elements (20) through the coils (10) through the foot switch (FIG. 1; 8) this forming chord G7.

As drawn in FIG. 8 the partial, electrical, schematic diagram illustrates the direct current flowing from the source (19) into the parallel leads through the electrical elements (20) through the coils (10) through the finger switch (6) thus forming the orchestrial accompaniment needed for advanced performances.

A guitar equipped with a Magic Chorder fret selecting means over its strings will give an extremely fast selection of chords and orchestrial sounds by means of the dual operation of foot and finger switches (FIG. 1; 8,6) whose circuits are programmed independently.

What is claimed is:

1. A stringed instrument fretting device, comprising: body means adapted to be secured to the neck of said instrument;

a plurlaity of fretting rods located within said body means in string fretting locations;

electromanetic means for actuating said rods;

circuit means for selectively activating said electromagnetic means;

finger-operated switches mounted on said body means and electrically connected with said circuit means for actuating a single rod to fret a single selected note; and foot-operated switches spaced from said body means but electrically connected with said circuit means for actuating a plurality of said rods to fret selected chords.

2. The fretting device of claim 1 wherein said body means consists of a base panel, at least one pair of spacing bars, a guide panel, and a housing panel, said base panel and said spacing bars defining a neck receiving cavity, said guide panel having rod guiding apertures therethrough and said housing panel having recesses therein to house said electromagnetic means; and connecting means for removably securing said panels and bars together and for removably securing said body means to said stringed instrument neck.

3. The fretting device of claim 1 wherein said body means consists of a base panel, at least one pair of spacing bars, a guide panel, and a housing panel, said base panel and said spacing bars defining a neck receiving cavity, and said guide panel having rod guiding apertures therethrough and having recesses concentric with said aperture for receiving said electromagnetic means.

4. The fretting device of claim 2 or 3 wherein said finger-operated switches are located on said base panel.

5. The fretting device of claim 2 or 3 wherein said electromagnetic means comprises solenoids.

6. The fretting device of claim 2 or 3 wherein said apertures have plastic tubes therein enclosing said rods and said rods have shock absorbing material affixed to the string contacting end.

* * * * *